US006219992B1

(12) United States Patent
Mäki-Rahkola et al.

(10) Patent No.: US 6,219,992 B1
(45) Date of Patent: Apr. 24, 2001

(54) DEVICE USED IN CONNECTION WITH WRAPPING OF A PIECE

(75) Inventors: Jari Mäki-Rahkola, Kauhajoki; Hannu Mäki-Rahkola, Päntäne, both of (FI)

(73) Assignee: Pesmel Oy, Kauhajoki (FI)

( * ) Notice: Subject to any disclaimer, the term of this patent is extended or adjusted under 35 U.S.C. 154(b) by 0 days.

(21) Appl. No.: 09/339,951

(22) Filed: Jun. 25, 1999

(30) Foreign Application Priority Data

Jun. 25, 1998 (FI) ..... 981460

(51) Int. Cl.[7] ..... B65B 61/20

(52) U.S. Cl. ..... 53/135.3; 53/157; 53/176; 53/587

(58) Field of Search ..... 53/587, 211, 212, 53/213, 214, 215, 399, 176, 415, 135.3, 135.2, 157

(56) References Cited

U.S. PATENT DOCUMENTS

| | | | | |
|---|---|---|---|---|
| 2,260,064 | * | 10/1941 | Stokes | 53/135.3 X |
| 3,678,646 | * | 7/1972 | Clark | 53/135.3 X |
| 4,432,187 | | 2/1984 | Elsner et al. . | |
| 4,691,497 | * | 9/1987 | Lancaster | 53/587 X |
| 4,736,567 | * | 4/1988 | Pienta | 53/135.3 |
| 4,757,667 | | 7/1988 | Elsner . | |
| 5,020,961 | | 6/1991 | Mäki-Rahkola et al. . | |
| 5,024,718 | | 6/1991 | Hannen . | |
| 5,054,263 | | 10/1991 | Mäki-Rahkola et al. . | |
| 5,086,610 | | 2/1992 | Mäki-Rahkola et al. . | |
| 5,092,109 | | 3/1992 | Mäki-Rahkola et al. . | |

FOREIGN PATENT DOCUMENTS

| | | |
|---|---|---|
| 0 324 674 | 7/1989 | (EP) . |
| 0 498 490 | 8/1992 | (EP) . |

* cited by examiner

*Primary Examiner*—Stephen F. Gerrity
(74) *Attorney, Agent, or Firm*—Connolly Bove Lodge & Hutz, LLP

(57) ABSTRACT

A method in connection with wrapping of a piece (K), in which method the piece (K) is rotated, and at least one wrapping film (3, 11) is supplied and guided around the piece (K) during the rotation. A label (E, E1) to be adhered to the piece (K) is supplied under one or several wrapping film layers (3*a*) forming around the piece (K) during the wrapping. A device applying the method. A manipulating device for manipulating one or several labels (E, E1) in connection with wrapping of a piece (K). The manipulating device (7) comprises at least one box-like receiving part (7*a*), an opening (7*b*) arranged at the end of the receiving part (7*a*) to receive the label (E), at least one box-like delivery part (7*d*) arranged as an extension to the receiving part (7*a*), an opening arranged at the end of the delivery part (7*d*) to feed the label (E, E1) from the delivery part (7*d*), at least one closing device (7*h*) for holding the label (E, E1) in the manipulating device (7), an opening (7*c*, 7*e*) between the delivery part (7*a*) and the delivery part (7*d*) to transfer the label (E, E1) from the receiving part (7*a*) to the delivery part (7*d*), and a controller (7*j*) arranged as an extension to the delivery part (7*d*) to guide the label (E, E1).

12 Claims, 4 Drawing Sheets

DEVICE USED IN CONNECTION WITH WRAPPING OF A PIECE

FIELD OF THE INVENTION

The present invention relates to a method in connection with wrapping of a piece. The invention relates also to a device in connection with a wrapping apparatus. Furthermore, the invention relates to a manipulating apparatus for manipulating one or more labels in connection with wrapping of a piece.

BACKGROUND OF THE INVENTION

It is known that pieces, such as cylindrical paper rolls, are wrapped by using wrapping apparatuses, known as such, which perform the wrapping by means of a wrapping film, preferably a transparent stretch film. One known wrapping apparatus is presented in patent publication U.S. Pat. No. 5,086,610. These wrapping apparatuses normally use a thin plastic film which is guided around the piece while the piece is rotated around its central line. When the wrapping film which is narrower than the piece is fed around the piece in the longitudinal direction of the piece, i.e. in the direction of the central line, it is also known to transfer the wrapping apparatus in the direction of the central line to wrap the whole envelope surface of the piece with several layers of the wrapping film. At the final stage of the wrapping, the film is cut and the end of the film can be welded on to other films by hot sealing. As to the techniques involved in cutting, sealing and feeding of the film, reference is made e.g. to patent publication U.S. Pat. No. 5,092,109. During the wrapping, the wrapping film is also stretched in a controlled way, as presented e.g. in patent publication U.S. Pat. No. 5,054,263 which is referred to in this respect.

After the wrapping, the pieces are also normally supplemented with a sheet-like label which comprises e.g. information about the material of the piece, identification codes, addresses, production data, text, figures, instructions, warnings, etc. In a known way, the label, or alternatively several labels, are attached on the outer surface of the outermost wrapping film layer on the wrapped piece, e.g. by manually pasting. Also, there are different known apparatuses which automatically add the required adhesive, such as hot-setting adhesive, on one surface of the label and transfer the label e.g. by pressing with feeding rolls onto the surface of a stationary piece. In the case of larger pieces, such as rolls of newsprint or magazine printing paper, the labels can be placed in position by a robot or a manipulator equipped with a gripping device operating on the suction principle. Furthermore, it is possible that the label is attached to the surface of the stopped piece before starting the wrapping.

However, a considerable drawback in the prior art presented above is the fact that the act of securing the adherence of the label during the different steps of transportation and manipulation of the piece sets considerable demands on e.g. the properties and endurance of the adhesive under various exposure conditions, the technical way of adhesion as well as the accuracy of the fixing. Moreover, varying ambient conditions can directly affect the label adhered onto the outer surface of the wrapped piece, involving the risk that the information may disappear at least partly if the label is not e.g. coated. A label placed onto the surface of the piece before the wrapping is difficult to read e.g. by a machine under several layers of wrapping film, particularly if the bar code of the label must be interpreted reliably, if the wrapping film is coloured, or if creases are formed on several film layers on the label.

Due to the facts presented above, pasting and fixing apparatuses of prior art for fixing a label become complex and expensive. Also, the materials for durable labels of special make may require distinct fixing methods specific to them. However, the piece itself or the wrapping film layers must not be damaged in connection with the fixing.

OBJECTS AND SUMMARY OF THE INVENTION

It is an aim of the present invention to present a considerable improvement to the prior art to eliminate the above-mentioned drawbacks and to present a very simple and effective method as well as an apparatus applying the method for providing a piece with one or more labels. It is an essential principle in the invention that the label is attached to the piece during the process of wrapping the piece and that the label is placed in between wrapping films.

By using the invention, several considerable advantages are achieved. By means of the invention, it is possible to avoid particularly the use of noxious adhesive or fixing substances, and thereby also the need to handle them is reduced. Also the need for separate devices intended for pasting is reduced. By totally eliminating pasting, also any damage caused by these substances to the wrapping film or to the piece itself is avoided.

When the label is placed underneath layers of wrapping film, the label itself is also effectively protected. Thus, the label used can also be of ordinary paper or paperboard, wherein the printing out of the identification data on the label is facilitated as well, because e.g. printers for printing on paper are generally available. Another considerable advantage of the invention is that it is equally easy to control the number of forming wrapping film layers under which the label is placed. This is done for example by feeding the label onto the film, or alternatively to the point of contact of the film and the piece, after a desired delay after starting the wrapping. By a timed control, a desired number of labels can be placed onto the piece, if the manipulating device in the apparatus is arranged suitable for manipulating and simultaneously storing several separate labels.

The invention can be implemented by simple equipment, which increases the reliability of the apparatus and reduces maintenance and down-time costs or time delays caused by these. In particular, when the label is placed onto the film, carried between two films or fed to the point of contact of two films, it is possible to use devices which are not arranged to be moved separately or to be precisely positioned by the piece to be wrapped. In an advantageous embodiment of the manipulating means of the apparatus according to the invention, the effect of gravity is utilized in a simple way to transfer the label in the vertical direction and to drop the label onto the wrapping film. The wrapping film is used to convey the label to the piece, and in this connection, also the suction effect of the moving film is effectively utilized, as will be described hereinbelow.

If the manipulating device according to the invention, and preferably also printing equipment, are arranged to be movable separately e.g. in a carriage on slide bars, it is possible to use very simple methods to serve various wrapping apparatuses to add labels onto different pieces. Another considerable advantage of the invention is that the apparatus can be connected to already existing wrapping apparatuses by very simple changes which are primarily made in the operation of their control devices. The work stages become more effective when the label is adjoined to the piece during the wrapping, wherein a separate labelling step before or after wrapping can be preferably totally eliminated.

The manipulating device is particularly suitable for such wrapping apparatuses in which the film is supplied as a continuous web moving in its longitudinal direction around the piece to be wrapped. Furthermore, a particular advantage is that the placement of the label underneath the film layers is possible without special devices requiring precise placement. The position of the label in the roll is controlled primarily indirectly by timing of the control system and not directly by placing. The manipulating means, particularly its closing means, operate actively under the control and preferably independently, wherein the means can be easily supplemented in old apparatuses as well without considerable changes in the structure. Preferably, the manipulating means operate by gravity, but if the means are equipped with rolls or sets of rolls controlled by the control system, the label can be fed from the means whose position and location in relation to the film may vary. It is an advantage of the manipulating means according to the invention that they are flexible, because they can be used to feed the label onto the film, into the contact point of the roll and the film, as well as into the contact point of two films.

As another considerable advantage of the invention, it should be mentioned that the adherence of the label on the wrapped piece is secured in a very simple and effective way. As a result, the disappearance of important identification data of the piece, and thereby for example in the case of different reels of paper, the disappearance of information on the paper quality, information needed at the location of use, as well as information which is important during the transportation stage, is avoided.

In the following, the invention will be described in more detail with reference to the appended drawings.

DETAILED DESCRIPTION OF THE INVENTION

Figure 1:
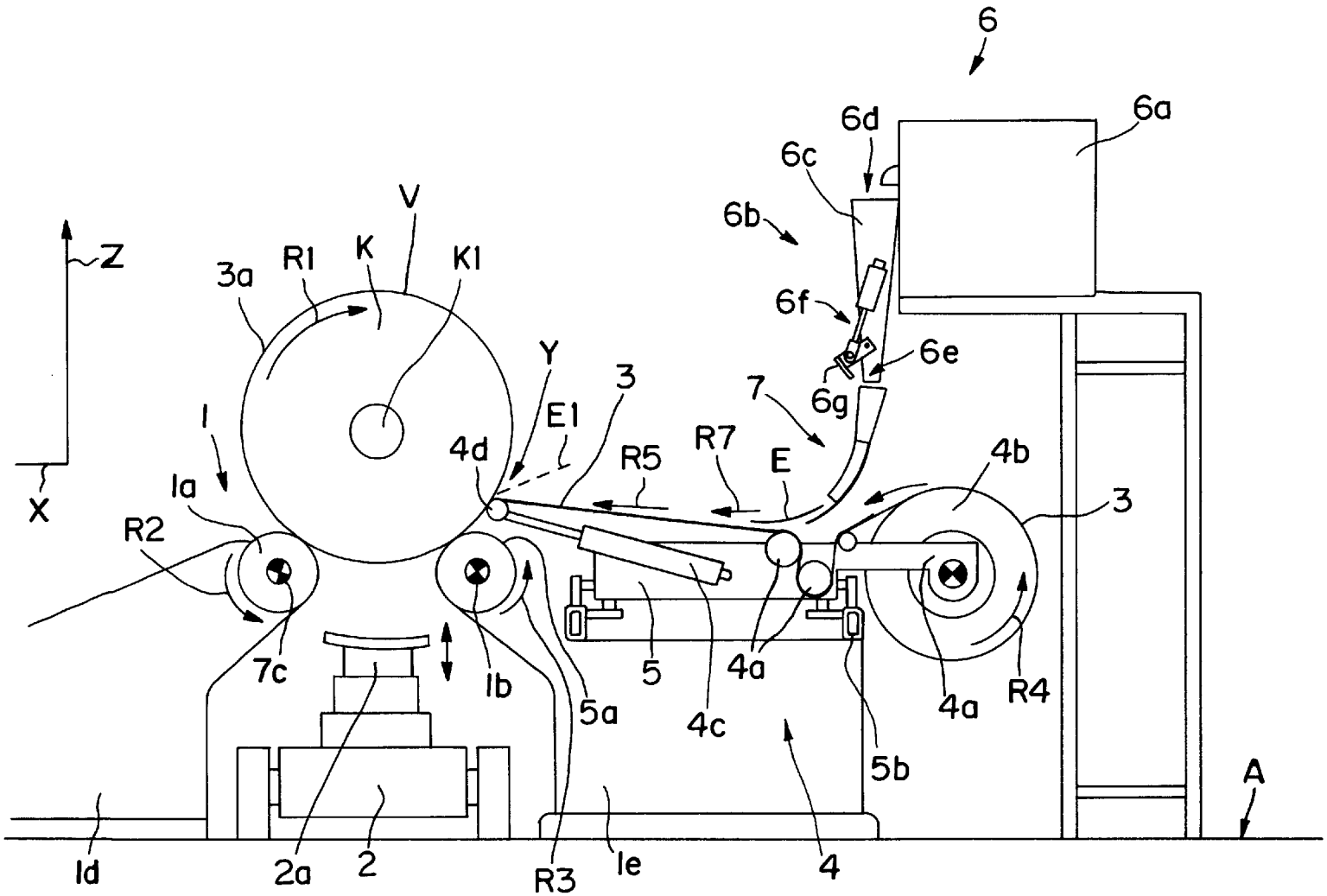
FIG. 1 shows a side view on an advantageous embodiment of the device according to the invention when applied in connection with a wrapping apparatus known as such.

FIG. 1 shows a wrapping apparatus of prior art, in connection with which the method and device according to the invention can be applied. This wrapping apparatus comprises rotating means 1 which comprise two elongated rolls 1*a* and 1*b* which are arranged to be substantially horizontal (arrow X) and parallel, and on top of which a cylindrical piece K is placed for wrapping. Advantageously, the horizontal length of the rolls 1*a* and 1*b* is longer than the horizontal length of the piece K. At least one of the rolls 1*a*, 1*b* is rotated by a drive 1*c*, which can be, in a way known as such, for example a centre drive, belt drive, chain drive, or the like. The rolls 1*a*, 1*b* are placed substantially on the same height in support structures 1*d* and 1*e* which are fixed on a support A in a stationary manner. In the presented wrapping apparatus, the piece K, such as a cylindrical paper reel K, is brought to the wrapping apparatus by means of a transfer carriage 2 which is arranged to be movable and which also comprises actuators 2*a* for lowering and lifting the piece K. These actuators 2*a* are used to lower the piece K onto the rolls 1*a*, 1*b* and to lift the piece K from the top of the rolls 1*a*, 1*b* to be transferred to further processing.

Further with reference to FIG. 1, the cylindrical piece K is placed for wrapping in a horizontal position in such a way that the longitudinal direction of the piece K is substantially in the horizontal plane, wherein its longitudinal direction is substantially parallel to the rotating rolls 1*a* and 1*b*. The longitudinal direction of the cylindrical piece K is the direction which corresponds to the direction of its central line or symmetry axis K1. With reference to FIG. 1, the longitudinal direction K1 is substantially perpendicular to the plane of drawing, and the horizontal plane constitutes a plane substantially perpendicular to the plane of drawing and parallel to arrow X. Further, with reference to FIG. 1, the vertical plane constitutes a plane substantially perpendicular to the plane of drawing and parallel to arrow Z. By using the rotating means 1, the piece K is brought to a rotary movement (arrow R1) around said central line K1, which remains preferably in its position during the rotation. The rotary movement of the first roll 1*a* (arrow R2) and the rotary movement of the second roll 1*b* (arrow R3) are, with reference to FIG. 1, primarily counter-clockwise during the wrapping, wherein the rotary movement of the piece K (arrow R1) is clockwise. If necessary, the piece K can also be rotated counter-clockwise.

Furthermore, it is obvious that the piece K can be fixed to the rotating means by using a shaft extending through the central line K1 of the piece K, wherein this shaft is mounted on bearings and coupled to the rotating means in a way known as such. Thus, the piece K is simultaneously supported and rotated by this shaft. By means of a corresponding shaft arrangement, it is possible to rotate also a vertical piece K. The vertical piece K can also be rotated on top of a support arranged to rotate, wherein the piece K can be placed e.g. on top of a pallet.

During the wrapping, a wrapping film 3, normally a thin stretch film 3, which is a flexible plastic film made of polyethylene, is supplied around the piece K. The piece K is normally wrapped under several stretch film layers 3*a*, the stretch film 3 being simultaneously stretched. The stretch film 3 forms said stretch film layer 3*a* when it is placed on the piece K or on previous stretch film layers 3*a*. With reference to FIG. 1, wrapping means 4 comprise rolling means 4*a*, known as such, for holding a stretch film roll 4*b*, and the stretch film roll 4*b* is mounted on bearings in the wrapping means 4 to allow rotation of the roll 4*b* (arrow R4). The rolling means 4*a* are arranged in such a way that the stretch film roll 4*b* rotates counter-clockwise, wherein the stretch film 3 is supplied in a continuous web from the roll 4*b* across the same to the left to stretching rolls of the rolling means 4*a* which have the function of stretching the stretch film 3 and of supplying the stretch film 3 in a substantially planar form to the piece K. The stretch film roll 4*b* can also be arranged to rotate clockwise, wherein the stretch film 3 is supplied from the stretch film roll 4*b* under the same. The rolling means 4*a* preferably also comprise a control roll 4*d* of the rolling means 4*a*, arranged at the end of an actuator 4*c*, such as a cylinder 4*c* driven by a pressurized medium. The control roll 4*d* is placed against the piece K or close to the piece K, whereby an elongated pocket-like joint Y is formed, and guides the stretch film 3 around the piece K. The wrapping means 4 are equipped with an actuator 4*c* for wrapping of pieces K with different diameters and for feeding the control roll 4*d* in connection with the same. Instead of said control roll 4*d*, it is also possible to use a guide surface which is designed to be curved and has preferably reduced friction to guide the film 3. Moreover, said control roll 4*d* and actuator 4*c* can be totally eliminated, wherein the film 3 is guided onto a mantle V by means of the roll 1*b*. Furthermore, the film 3 can be guided onto the mantle V also tangentially to the piece K, wherein the piece K and the direction R5 of feeding the film 3 touch each other at a contact point Y. As to the details of manipulating the stretch film, which are known as such, reference is made to patent publication U.S. Pat. No. 5,092,109, wherein a more detailed description is not necessary in this context. In accordance with a preferred embodiment of FIG. 1, the stretch film 3 is supplied around the piece K under the same, and the stretch film 3 is guided into a contact with the piece K to a location before the roll 1*b* of the rotating means 1.

Because the width of the stretch film 3 is usually shorter than the length of the piece K to be wrapped in the longitudinal direction, the wrapping means 4 of the wrapping apparatus must be transferred in the longitudinal direction of the piece K to cover the whole mantle surface V of the piece with the stretch film 3. Thus, in a way known as such, the wrapping means 4 are fixed in a transfer device 5 which is arranged to be movable and which in the apparatus shown in FIG. 1 is arranged on a support structure 1*e*, to be movable in the horizontal direction and substantially parallel with the longitudinal direction of the piece K. The transfer device 5 is moved to guide the stretch film 3 onto the mantle surface V, wherein the piece K is wrapped gradually and wherein the stretch film 3 is placed partially on top of the previous stretch film layer 3*a* and on the piece K. By operating in a corresponding manner, new stretch film layers 3*a* can be added on top of the stretch film layers 3*a* already made.

With reference to FIG. 1, the stretch film 3 is guided by means of the rolling means 4*a* from the roll 4*b* into a contact with the piece K, wherein the stretch film 3 is substantially planar on at least part of the path, and in relation to the feeding direction (arrow R5) of the stretch film 3, its transverse direction is substantially parallel with the longitudinal direction of the piece K. However, in the longitudinal direction (arrow R5) of the stretch film 3, the inclination of its different planar areas may vary in a desirable manner.

A label E to be attached to the piece K is usually of paper or paperboard made of a cellulose-based material and is suitable for use in a printer 6*a*, preferably a laser printer 6*a*, which is adapted to print the required data or figures, e.g. a bar code, on the label E. Also ready-printed labels E can be used to attach warnings and instructions to the piece K.

The label E to be attached to the piece K is typically a sheet whose width is normally shorter than the length of the piece K to be wrapped. Similarly, the length of the label E is normally shorter than the perimeter of the mantle V of the piece K. However, it is obvious that the length of the label E can be multiple with respect to its width, wherein the label E may extend around the whole piece K and the length of the label E substantially corresponds to the perimeter of the mantle V. In an advantageous embodiment of the invention, the width of the label E is preferably narrower than the width of the stretch film 3 to be used in the wrapping apparatus, so that the placement of the label E in its entirety under the stretch film layer 3*a* on the piece K could be secured without feeding a new stretch film layer 3*a* on top of the label E when the piece K has rotated (arrow R1) one rotation. At the same time, it is secured that the label E does not adhere to the rolls 1*a* and 1*b*. In an advantageous embodiment of the apparatus according to the invention, the placement of the label E on top of the stretch film 3, preferably on its planar part, is arranged in such a way that the whole label E is placed substantially in planar position on top of the stretch film 3 before it is brought to the point Y of contact with the piece K. Furthermore, the label E is placed advantageously on the straight portion of the stretch film 3 which is not equipped with guide rolls placed above the stretch film 3 and having substantially the width of the stretch film 3, wherein the detachment of the label E from the film 3 is avoided in connection with this roll.

According to an advantageous embodiment of the invention, it is also possible to place means between a manipulating apparatus 7 and the piece K to guide a second wrapping film 11 in a direct contact with the stretch film 3, wherein the label E is advantageously guided with the film 3 in between the stretch films 3 and 11 to be fed in parallel, and further onto the piece K. The stretch films 3 and 11 are at least partly on top of each other, and to secure a reliable transfer, the label E is at least partly in between them. Thus, the wrapping apparatus can also be equipped with rolls between the piece K and the manipulating apparatus 7 to change the direction of feeding of the films, wherein e.g. the directions of the rotation axes of the cylindrical piece K and the film roll 4*b* may differ from each other. Furthermore, it is obvious that the second film 11 can be added also when the label E is located on the lower surface of the film 3. Moreover, it is obvious that the label E can be placed on this second film 11.

Further, with reference to FIG. 1, the apparatus is arranged to supply the label E onto the surface of a moving stretch film 3. The label E is placed onto the surface of the stretch film 3 so that it might be transferred further with the stretch film 3 onto the mantle V of the piece K under the stretch film layer 3*a*. There may already be several stretch film layers 3*a* around the piece K, wherein the label K is transferred onto these layers 3*a*, but also in this case the label E is placed between the piece K and the stretch film layer 3*a* fed simultaneously.

With reference to FIG. 1, the device is also arranged in such a way that the label E is supplied onto the top surface of the moving stretch film 3 from above, wherein it descends (arrow R7) by gravity onto the film 3 and stays on the film 3. The stretch film 3 can also be electrically charged, wherein a label E with an opposite charge adheres to the stretch film 3 also by means of electrostatic attraction. The transfer of the label E onto the film 3 is particularly facilitated by a layer of air moving with the film 3 in its direct vicinity, tending to suck the label E with it when the speed of the film 3 and the position of feeding the label E are suitably set. When the film 3 conveys the label E, their mutual position remains preferably unchanged, wherein the label E is not displaced on the film 3 or does not drop off the film 3. Naturally, it is obvious that the adherence of the label E, particularly its front edge, on the layer 3, particularly on the lower surface of the film 3, can be secured at least in poor conditions by adding an adhesive. Thus, preferably a harmless adhesive is sprayed onto a desired location of the label E e.g. in connection with a guide means 7*j*.

In an advantageous embodiment of the device and method of the invention, a phenomenon is applied, wherein the adherence of the label E to the film 3 is based on the so-called Bernoulli effect. This phenomenon is based on the fact that the pressure of air moving with the moving film 3 in its direct vicinity is, due to its movement, lower than the pressure of ambient air which is substantially stagnant, wherein this ambient pressure pushes the label E against the moving film 3. According to the Bernoulli effect, known as such, when the flow rate of a fluid or an air stream increases, its pressure will also decrease. In connection with the film 3, air can be brought to movement by means of the movement of the film 3 and by the friction between the air and the film 3. As a result of this phenomenon, with reference to FIG. 1, the label E can be also supplied on the lower surface of the moving stretch film 3, where it remains at least partly by means of the suction effect described above. The adherence of the film 3 and the label E to each other can also be strengthened by a static electric charge as mentioned above. Preferably, only the suction effect is utilized, because static charges also tend to move impurities, such as dust from the air, from the environment onto the film 3.

On the basis of the description above, it is obvious that the label E can be transferred with the film 3 also in such a wrapping apparatus which is arranged to rotate a piece K arranged in a substantially vertical position. Thus, it is advantageous that the transverse direction of the film 3 to be supplied is arranged substantially parallel to the vertical direction (arrow Z). With reference to FIG. 1, the film 3 can be supplied around the piece K also above the piece K, wherein the piece K is rotated counter-clockwise. Thus, the label E adhered onto the lower surface of the film 3 is transferred under the film layer 3*a* at the contact point Y of the film 3 and the piece K.

In accordance with an advantageous embodiment of the invention, the manipulating device 7 can be placed in the wrapping apparatus also in such a way that the label E is supplied directly to the contact point Y. This is illustrated in FIG. 1 with a label E1 shown by a broken line. Also here it is possible to utilize the suction effect of the moving film 3 and to place the edge of the label E onto the film 3 before the meeting point of the film 3 and the piece K. Thus, the label E may at the same time be partly both under the wrapping film layer 3*a* and in connection with the manipulating device 7. The same situation may also occur when a longitudinal label E is supplied onto the upper or lower surface of the film 3, when the length of the label E is greater than the distance between the manipulating device 7 and the contact point Y, measured along the film 3. The point of feeding on the mantle V of the piece K may vary according to the size of the piece K to be wrapped. Feeding to the presented point is performed preferably when the mantle V of the piece K remains during the rotation substantially on the same level, i.e. at the same distance from the axis of rotation, as in the case of a cylindrical, barrel-shaped or conical piece. Thus, the axis of rotation preferably joins the axis of symmetry of the piece K. In the case of pieces K with varying shape of mantle surface V, the label E is supplied preferably with the film 3, wherein the risk of collision of the piece K and the manipulating device 7 is smaller and the precise positioning of the manipulating device 7 in relation to the piece K can be avoided. Thus, the wrapping of e.g. a conical piece can be arranged in a way presented in the patent publication U.S. Pat. No. 5,092,109. When the label E is supplied to the contact point Y, the delivery part 7*d* of the manipulating device 7 can be equipped with feeding means, for example a roll or a pair of rolls, in such a way that the label E is fed and guided by means of these from the substantially stationary manipulating device 7 to the contact point Y. If necessary, the manipulating device 7 can be brought to the vicinity of the contact point Y by means of a transfer apparatus, and the label E can be dropped to the contact point Y between the film 3 and the piece K.

Further, with reference to FIG. 1, the apparatus according to the invention comprises printing means 6 for printing the label E. The printer 6*a* is for example a laser printer, an ink-jet printer, a thermal printer, a matrix printer, or the like, which may be a printer known as such and generally used, controlled in a way known as such via a parallel bus or a serial bus from a data processor, such as a computer or a programmable logic controller 10*a* (PLC). If necessary, it is also possible to use wireless data transmission. In accordance with an advantageous embodiment of the invention, the printing means 6 also comprise storage means 6*b* for storing the printed label E before guiding it to the manipulating means 7, whose operation will be described below. The storage means 6*b* comprise a housing structure 6*c* which is preferably fully closed on its sides and which comprises in its upper part, with reference to FIG. 1, an opening 6*d* for feeding the label E received preferably from the printer 6*a* into the housing structure 6*c*, and in its lower part an opening 6*e* to guide the label E further to the manipulating means 7. The housing structure 6*c* comprises also a cylinder 6*f* operated e.g. with a pressurized medium, such as a hydraulic fluid or pressurized air, to control an articulated gate valve 6*g* closing and opening the opening 6*e* in the lower part. The printing means 6, which are in a stationary position in relation to the wrapping apparatus, are arranged to deliver labels E to one or several manipulating means 7 arranged in different moving transfer devices 5. The cylinder 6*f* is controlled e.g. by means of the logic controller 10*a* and control valves 10*b*. The gate valve 6*g* is used to prevent the delivery of the label E before the transfer device 5 with its manipulating means 7 is moved in connection with the printing means 6 and positioned with the housing structure 6*c* to transfer the label E preferably by gravity (arrow R6, FIG. 3) to the manipulating means 7.

In an advantageous embodiment of the invention, the printing means 6 are placed in a fixed and stationary position in relation to the wrapping apparatus. The wrapping means 4 are placed at least partly in the transfer device 5 arranged movable on rails 5*a* and 5*b* and equipped also with the manipulating means 7. With reference to FIG. 1, the manipulating means 7 are placed in a substantially fixed position in relation to the stretch film 3. Instead of the fixed position, the printing means 6 can also be arranged in the transfer device 5 in connection with the wrapping means 4, wherein the housing structure 6*c* and the gate valve 6*g* can be totally eliminated and their functions be performed by the manipulating means 7.

Figure 2:
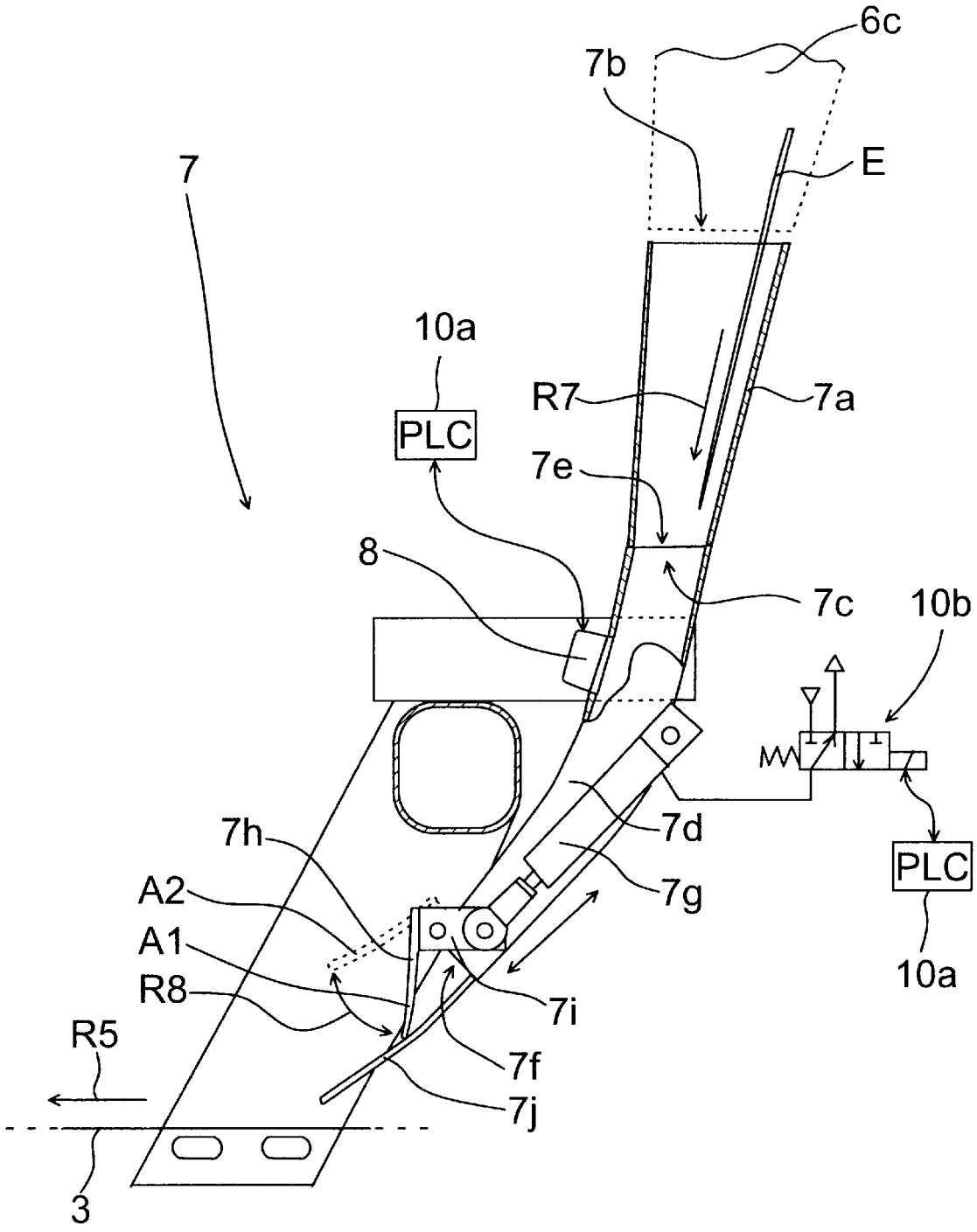
FIG. 2 shows an advantageous embodiment of the manipulating device according to the invention seen in a side view.

With reference to FIGS. 1 and 2, the apparatus according to a preferred embodiment of the invention comprises at least one set of manipulating means 7 for the purpose of receiving one or several labels E from the printing means 6, to store the label E temporarily before placing it onto the stretch film 3 or feeding it at a desired moment. For the sake of clarity, FIG. 2 is also supplemented with the stretch film 3 to be supplied and the housing structure 6*c* of the printing means 6 in a partial cross-section.

With reference to FIG. 2, the manipulating means 7 according to an advantageous embodiment of the invention comprise a box-type receiving part 7*a* which is preferably wholly enclosed on its sides, an opening 7*b* fitted in the upper part to receive the label E, an opening 7*c* fitted in the lower part to guide the label E to the delivery part 7*d*. When the label E is transferred by gravity, the receiving part 7*a* is above the delivery part 7*d* which, in turn, is located above the stretch film 3 to be supplied. The receiving part 7*a* has preferably a rectangular cross-section, arranged conical in the vertical direction, and its width is greater than the width of the label E. The box-type delivery part 7*d* is preferably fully closed at its sides, and it comprises an opening 7*e* fitted in the upper part to receive the label E and an opening 7*f* fitted in the lower part to supply the label onto the moving film 3. The delivery part 7*d* has preferably a rectangular cross-section and is designed to have a curved shape to guide the position of the label E at the feeding stage. The width of the delivery part 7*d* substantially corresponds to the width of the receiving part 7*a*.

The delivery part 7*d* also comprises a cylinder 7*g* which is operated e.g. with a pressurized medium and which controls, by means of an articulation 7*i*, a gate valve 7*h* (arrow R8) closing (position A1 of the gate valve 7*h*) and opening (position A2 of the gate valve 7*h*) the opening 7*f* placed in the lower part of the delivery part 7*d*. When the gate valve 7*h* closes (position A1) the opening 7*f*, the transfer of the label E onto the film 3 is prevented and the label E is kept in the delivery part 7*d*. Alternatively, or in addition to the gate valve 7*h*, the delivery part 7*d* may comprise for example cylindrically operated friction means to hold the label by pressure. The cylinder 6*f* is controlled e.g. by means of the logic controller 10*a* and the control valves 10*b*.

The opening 7*f* in the lower part of the delivery part 7*d* may also be fitted to accommodate a roll or a pair of rolls, wherein the label E is transferred further by means of their rotation. When they are stopped, the advancing of the label E is prevented or the label E is kept in position by friction. The actuator of said roll or pair of rolls receives from the data processing unit the necessary control signal for starting and stopping. The delivery part 7*d* also comprises a planar and protruding control means 7*j* as an extension to its lower part, for the purpose of guiding the label E in the correct position onto the film 3. The different parts of the manipulating means 7 are preferably designed or treated so that the label does not adhere to the structures, e.g. their joint locations, but it slides on their surface easily forward also when gravity is the only force transferring the label E forward.

Figure 3:
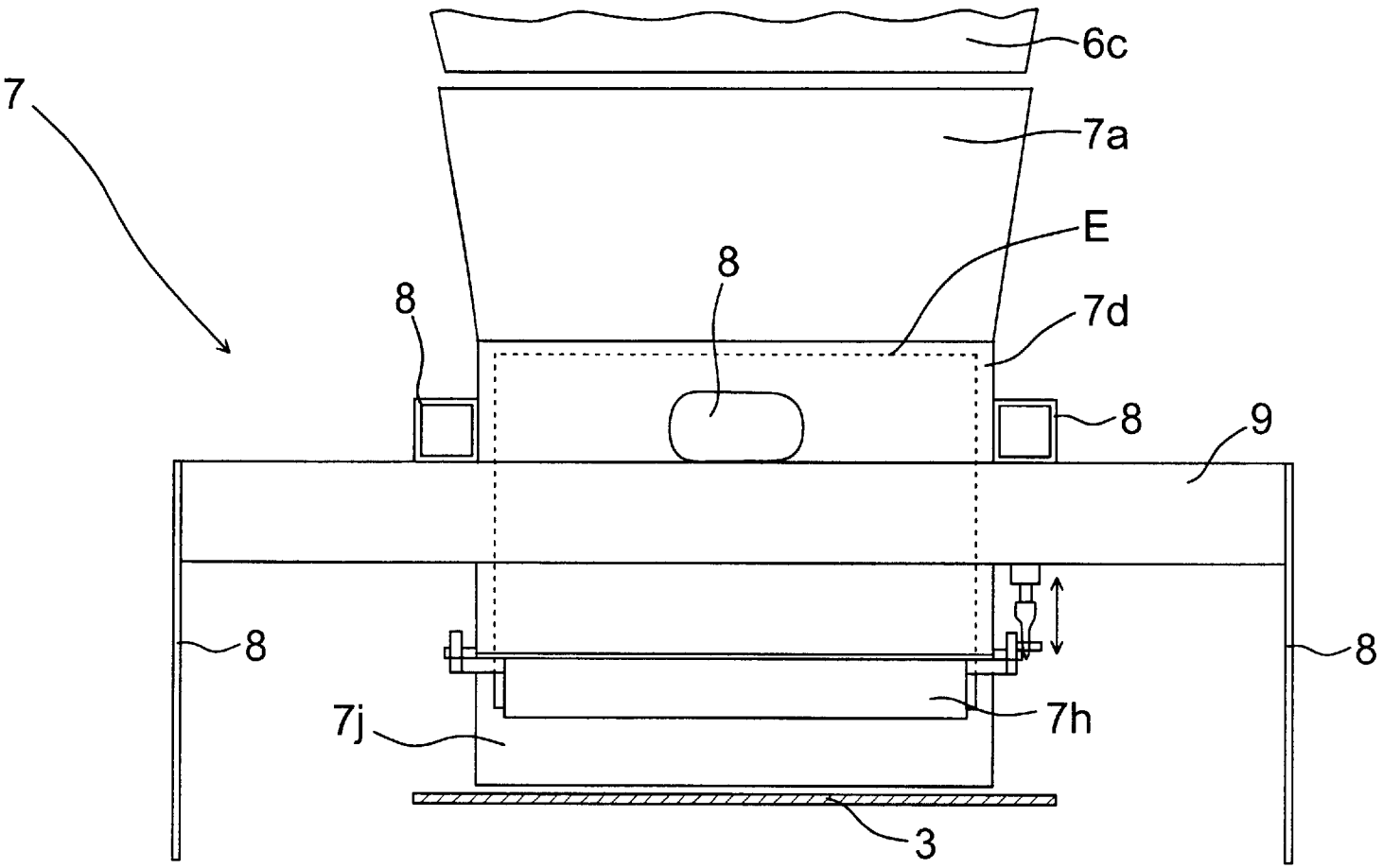
FIG. 3 shows the manipulating device of FIG. 1 seen from the front.

Depending on the size of the label E, it may extend simultaneously both to the receiving part 7*a* and the delivery part 7*d*. With reference to FIG. 3, the label E is presented as being placed in the delivery part 7*d* , wherein its dropping is prevented by the gate valve 7*h* and wherein it does not extend to the receiving part 7*a*. It is possible to provide a valve structure, a roll or a pair of rolls corresponding to the above-presented gate valve 7*h*, between the receiving part 7*a* and the delivery part 7*d*, to transfer the label E stepwise or to keep two different labels simultaneously both in the receiving part 7*a* and in the delivery part 7*d*. If a large label E extends to both of these parts 7*a* and 7*d*, one must take care that said valve structures or the like are in the opened position or otherwise allow the free transfer of the label E and its feeding from the delivery part 7*d* onto the moving stretch film 3 or to the contact point Y. In addition, it is obvious that several delivery parts 7*d* or receiving parts 7*a* can be arranged in succession. Furthermore, it is obvious that several receiving parts 7*a* can be placed next to each other for receiving several labels E from the printing means 6. Moreover, it is obvious that also several delivery parts 7*d* can be placed next to each other to feed several labels E onto the film 3. If necessary, the apparatus also comprises actuators and control means to position the delivery part or parts and the receiving part or parts in relation to each other to move labels E therebetween.

Advantageously, the manipulating means 7 are also equipped with sensor means 8, known as such, e.g. a photosensitive cell 8 adapted in an opening formed in the receiving part 7*a*, to detect the entry or delivery of a label E in the delivery part 7*d*, in the receiving part 7*a*, or in both of them. This data can also be used to report a malfunction to the data processing unit 10*a* of the control system. Preferably, the receiving part 7*a* and the delivery part 7*d* form a substantially integrated structure which is at least partly made of the same material blank, to manipulate one or several labels according to FIGS. 2 and 3, wherein also the openings 7*c* and 7*e* are joined. With reference to FIG. 2, the manipulating means 7 also comprise fixing means 9 for connecting the manipulating means 7 with the transfer device 5.

In accordance with an advantageous embodiment of the invention, the manipulating means 7 are arranged to be used in such a way that one or several ready-printed labels E are fed manually to their receiving part 7*d* before starting the wrapping, and under control by the control system, the label E or several labels E are fed in different steps to the stretch film 3 or the contact point Y during the wrapping. According to another embodiment, the printer 6*a*, the housing structure 6*c* or both of these are replaced by a device feeding ready-printed labels E, known as such, a stack of labels being stored in a cassette in the feeding device. According to an advantageous embodiment, the labels E are fed from a roll, and the device also comprises means for cutting the material to be supplied from the roll in a desired dimension to form the label E.

Figure 4A:
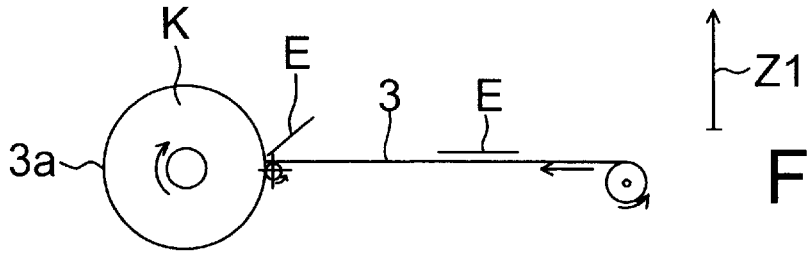
FIGS. 4*a*–4*e* illustrate the application of the method according to the invention in reduced skeleton diagrams.
Figure 4B:
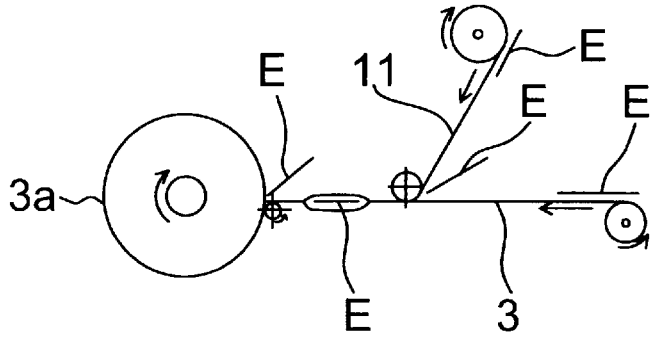
Figure 4C:
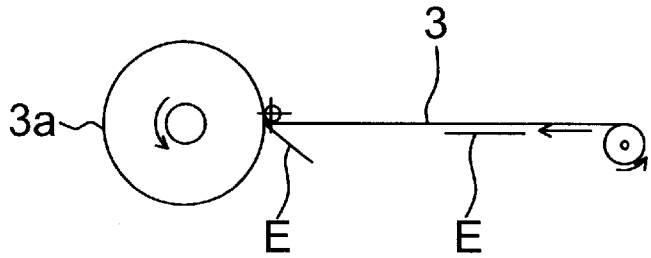
Figure 4D:
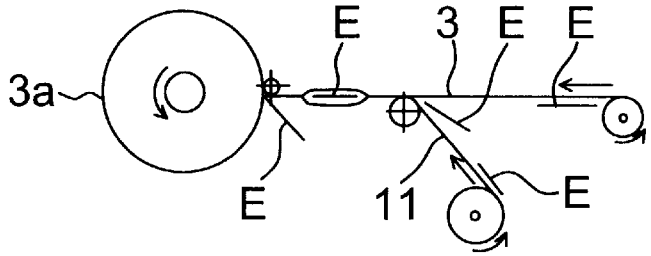
Figure 4E:
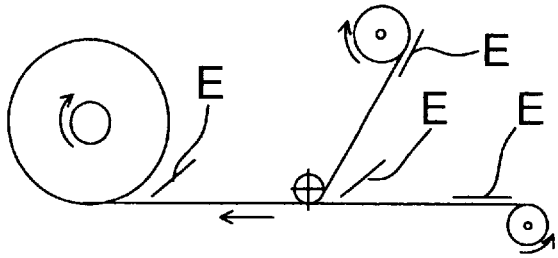

FIGS. 4*a*–4*e* illustrate some advantageous embodiments of the method according to the invention. One should note that according to the different embodiments in the description above, the direction Z1 may correspond to the vertical direction, when e.g. a cylindrical piece K is placed substantially in the horizontal position for the duration of wrapping, and to the horizontal position, when e.g. a cylindrical piece K is placed substantially in the vertical position for the duration of wrapping. Furthermore, it is obvious that when the positions of the wrapping means 4 and thereby the manipulating device vary according to the different alternatives presented, the direction Z1 may also correspond to the horizontal direction, wherein the piece K may be placed in the horizontal position or in the vertical position in relation to the support A. Moreover, one should note that the roll shown in connection with the piece K in FIGS. 4*a*–4*e* can be the above-mentioned control roll 4*d* of the actuator 4*c* or the roll 1*b* of the rotating means 1. In addition, FIGS. 4*a*–4*e* show in the same figure several labels E to illustrate different alternatives for their feeding points and transfer. Moreover, it is obvious that the presented different alternatives can also be applied in connection with the same wrapping apparatus. FIGS. 4*a*–4*e* also show the direction of rotation of the piece K. FIGS. 4*a* and 4*c* illustrate the placement of the label E onto the film 3 and its feeding to the contact point Y. FIGS. 4*b* and 4*d* show the placement of the label E onto the film 3, its feeding between two films 3 and 11 and its transfer therebetween. By means of the film 3 or the films 3 and 11, the label E is transferred to the contact point Y. FIG. 4*e* also illustrates tangential feeding of the films 3 and 11.

It will be appreciated by a man skilled in the art that the invention is not limited only to the preferred embodiments presented above but it may vary within the scope of the appended claims. Furthermore, it is obvious that the piece may consist of one or several pieces of identical or different shape which are enclosed under joint layers of wrapping film during the wrapping.

We claim:

1. A wrapping device, comprising:

a rotating means (1) to rotate a work (K) substantially in its position around its central line (K1);

a wrapping means (4) to supply at least one wrapping film (3, 11) and to guide the wrapping film as a continuous web around the work (K) during the rotation; and at least one set of manipulating means (7), controlled by a control system (10*a*), for storing one or several labels (E, E1) and feeding the labels from the manipulating means (7) at a pre-determined moment to be adhered to the work (K) under one of several wrapping film layers (3*a*), formed around the work (K), during the wrapping; wherein, said manipulating means (7) has at least one receiving part (7*a*) for receiving the label (E, E1) to be adhered to the work (K), at least one delivery part (7*d*) arranged as an extension to said receiving part (7*a*) for feeding the label (E, E1), and at least one set of closing means (7*h*), controlled by the control system (10*a*), to hold the label (E, E1) in the manipulating means (7) and to feed the label (E, E1) from the manipulating means at a pre-determined moment.

2. A device according to claim 1, characterized in that said delivery part (7*d*) is equipped with at least one roll to be started and stopped in a controlled manner to hold and transfer the label (E, E1).

3. A device according to claim 1, characterized in that the manipulating means (7) are equipped with sensor means (8) coupled to the control system (10*a*) to detect the entry and delivery of the label (E, E11).

4. A device according to claim 1, characterized in that said manipulating means (7) are arranged to feed the label (E, E1) onto the wrapping film (3, 11) moving in its longitudinal direction to be transferred therewith under said wrapping film layer (3*a*).

5. A device according to claim 1, characterized in that said manipulating means (7) are arranged to feed the label (E, E1) to a contact point (Y) of the rotating work (K) and the moving wrapping film (3, 11).

6. A device according to claim 1, characterized in that said manipulating means (7) are arranged to feed the label (E, E1) between two or more wrapping films (3, 11) moving in their longitudinal direction to be transferred therewith under said wrapping film layer (3*a*).

7. A device according to claim 1, characterized in that the wrapping means (4) are arranged in a transfer device (5) which is arranged movable in the direction of the central line (K1) of the piece (K) to wrap a whole mantle surface (V) of the work (K), and that said manipulating means (7) are arranged in said transfer device (5).

8. A device according to claim 1, characterized in that the manipulating means (7) are arranged in a carriage arranged to be movable to serve one or several wrapping apparatuses.

9. A device according to claim 1, characterized in that the device also comprises a printing means (6) arranged in a fixed position and controlled by the control system (10*a*) to produce a label (E, E1), to store the label and to guide the label at a pre-determined moment to the manipulating means (7), after the manipulating means (7) has been transferred in connection with the printing means (6) and positioned to feed the label.

10. A device according to claim 9, characterized in that said printing means (6) comprises a device feeding ready-printed labels (E, E11).

11. A device according to claim 9, characterized in that said printing means (6) is arranged to feed labels (E, E11) from a roll, and that the device also comprises a means for cutting a material to be fed from a roll into a desired dimension to form the label (E, E11).

12. A device according to claim 9, characterized in that said printing means (6) comprises a printer (6*a*) for forming the label (E, E1) and storage means for receiving the printed label (E, E1), which storage means (6*b*) comprises a box structure (6*c*) having an opening (6*d*) in its upper part to feed the label (E) received from the printer (6*a*) into the box structure (6*c*) and an opening (6*e*) in the lower part to guide the label (E) further to the manipulating means (7), as well as an articulated gate valve (6*g*) closing and opening the opening (6*e*) in the lower part.

* * * * *